United States Patent [19]

Beeland

[11] Patent Number: 4,563,794

[45] Date of Patent: Jan. 14, 1986

[54] SELF-CLEANING ROLLER GIN

[75] Inventor: William D. Beeland, Columbus, Ga.

[73] Assignee: Lummus Industries, Inc., Columbus, Ga.

[21] Appl. No.: 618,234

[22] Filed: Jun. 7, 1984

[51] Int. Cl.[4] ..... D01B 1/06

[52] U.S. Cl. ..... 19/48 R; 19/50

[58] Field of Search ..... 19/43, 48 R, 49–54, 19/108

[56] References Cited

U.S. PATENT DOCUMENTS 1,183,035 5/1916 Rooney et al. ..... 19/108

3,251,094 5/1966 Vandergriff ..... 19/50 X 4,262,390 4/1981 Einglett et al. ..... 19/50

*Primary Examiner*—Louis K. Rimrodt

*Attorney, Agent, or Firm*—Woodford R. Thompson, Jr.

[57] ABSTRACT

Disclosed is an improved roller gin having means for cleaning debris from the knife, and a process of operating such gin. Specifically, the gin includes means to rotate the roll in reverse, periodically, if desired, whereby any cotton, leaf, or other trash draped over the knife is thrown off or discharged from the gin. Means also is disclosed to operate the gin and its feeder in a fashion to gin all cotton enroute from the feeder to the gin prior to the gin going through its cleaning operation.

3 Claims, 7 Drawing Figures

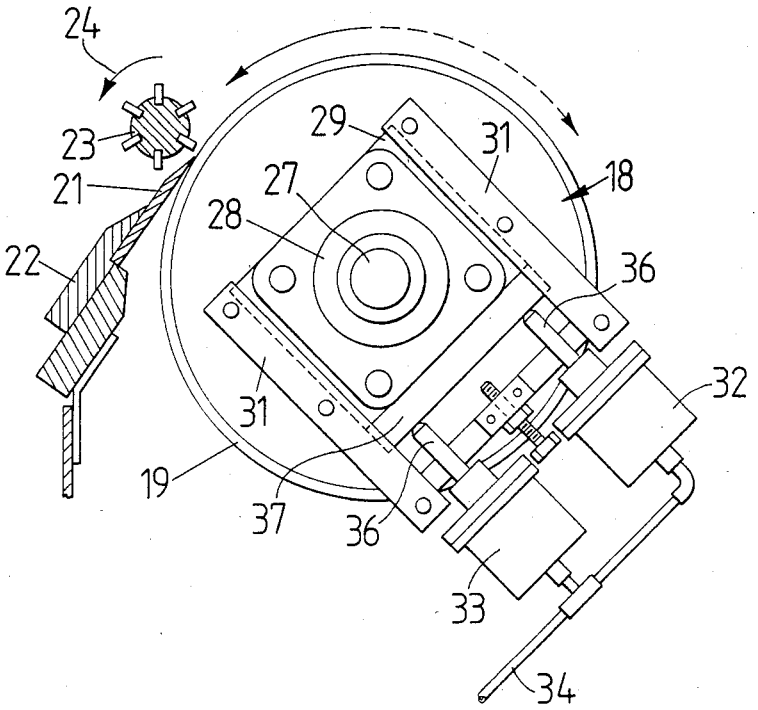
Fig. 4
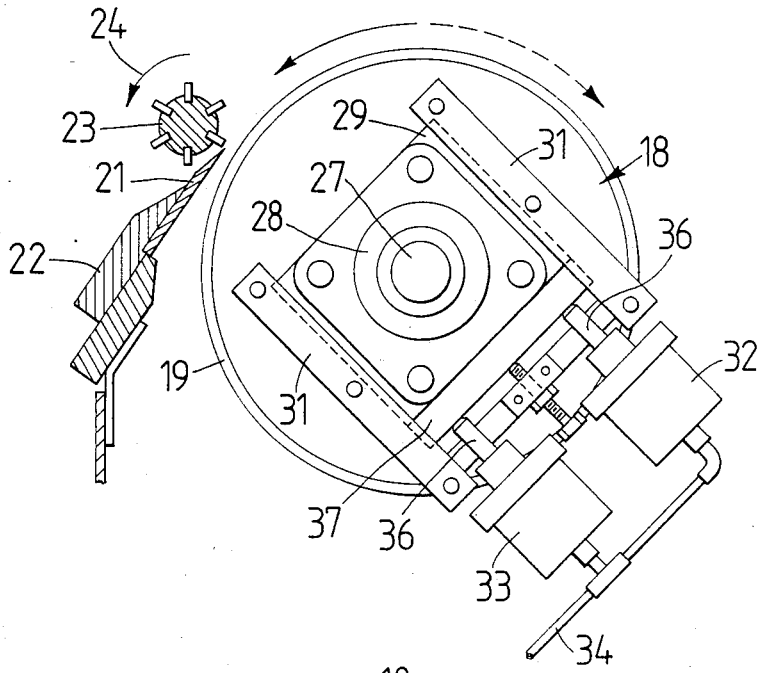
Fig. 5
Fig. 6
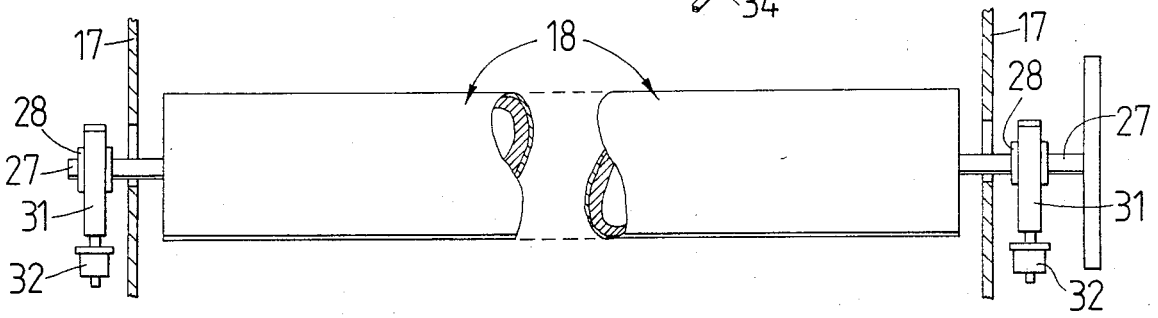

SELF-CLEANING ROLLER GIN

BACKGROUND OF THE INVENTION

My invention relates to roller gins.

In the art to which my invention relates it is well known that the efficiency of roller gins depends, in large measure, on removing the build-up of foreign matter on or adjacent the cutting edge of the knife which cooperates with the roll, the knife and roll forming the mechanism which removes lint from the seed cotton as it is fed to the apparatus. Attempts have been made to clean knives by intermittently blowing the trash from the knife cutting edge with blasts of air or the like. The assignee of this application owns U.S. Pat. No. 4,262,390 dated April 21, 1981, "ROLLER GIN AND FEED SYSTEM INCORPORATING THE SAME" which shows air cleaning of the knife. While the apparatus shown in the above patent is satisfactory, my present invention is an improvement over that apparatus and so far as I am aware, over all previous apparatus and processes for cleaning roller gin knives.

Briefly, my invention incorporates associating with the usual and customary parts of a roller gin means automatically to clean the knife, either intermittently or at predetermined, set intervals of time, by first stopping the feed to the gin and then releasing the pressure between the knife and roller, following which the roller is reversed for a few revolutions, thus causing trash such as cotton, leaf particles, etc. draped over the knife to be removed therefrom. While as will be explained hereinafter, there are other details to my improved process of operating roller gins with regard to the motion between the roller and knife for cleaning purposes, nevertheless the general concept of my invention is just as stated, namely, to reverse the direction of rotation of the roll thus to remove trash from the cutting edge of the knife.

SUMMARY OF THE INVENTION

In view of the foregoing it will be seen that broadly it is the object of my invention to provide a roller gin and process of operating the same in which the gin automatically and at predetermined intervals if desired interrupts its ginning operation and goes through a blade cleaning sequence.

My invention also has for an object the provision of the process of operating a roller gin embodying a sequence in which the mechanism feeding the seed cotton to the gin comes to a halt, after which the gin is permitted to run for a length of time to clear all unginned cotton between the knife-roll and feeder mechanism. Then, the motor driving the gin is deenergized allowing the ginning roll to coast to a stop utilizing the friction between roll and knife for braking following which the ginning roll is slightly retracted to remove the knife from major friction contact with the roll. The motor is again started in reverse and allowed to obtain full speed. With the ginning roll going full speed it is advanced to create full friction contact with the knife while the motor driving the ginning roll continues to run in reverse for a preset time. This removes the lint which is draped over the cutting edge of the knife or otherwise clinging to the knife adjacent its edge. The motor driving the gin is again deenergized allowing the ginning roll to coast to a stop utilizing the friction between roll and knife for braking. The ginning roll is now retracted to remove the knife friction, the motor driving the ginning roll is started in the forward direction and allowed to obtain full speed whereupon the roller is brought back into ginning contact with the knife, thus completing one cycle in the cleaning operation.

As will hereinafter appear, the description of the apparatus given in this application is in accordance with that shown and described in the aforesaid U.S. Pat. No 4,262,390 dated April 21, 1981. However, as those skilled in the art become aware of my improvement it will be apparent that the same may be applied to roller gins constructed differently, certainly in detail, from the one shown in said patent.

BRIEF DESCRIPTION OF DRAWINGS

Apparatus illustrating a roller gin incorporating my invention and which may also be used to carry out my improved process is shown in the accompanying drawings forming a part of this application in which:

FIG. 4 is an end elevational view of one of the mechanisms for movably mounting one end of the gin roll shaft, the knife, holder, etc., being in cross section;

FIG. 5 is a view corresponding to FIG. 4 and showing the mechanism for moving the opposite end of the ginning roll shaft with the knife out of contact with the roll;

FIG. 6 is a partial, diagrammatic sectional view of the ginning roll and the mechanism shown in FIGS. 4 and 5, removed from the gin structure itself; and, FIG. 7 is a wholly diagrammatic wiring diagram.

DETAILED DESCRIPTION

Figure 1:
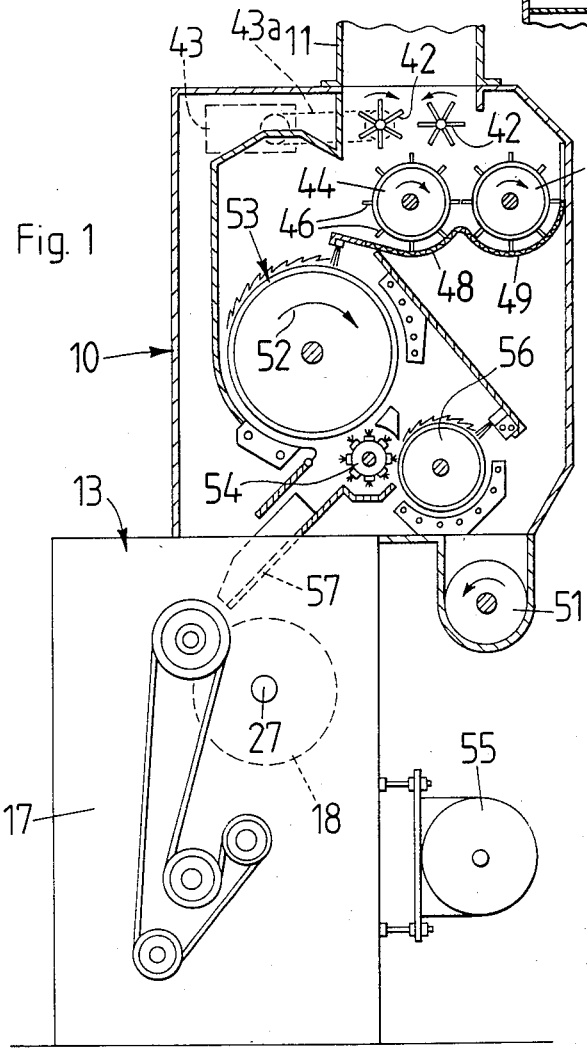
FIG. 1 is an end elevational view looking at one end of a roller gin and feeder combination, the feeder section being shown partly in cross section.
Figure 2:
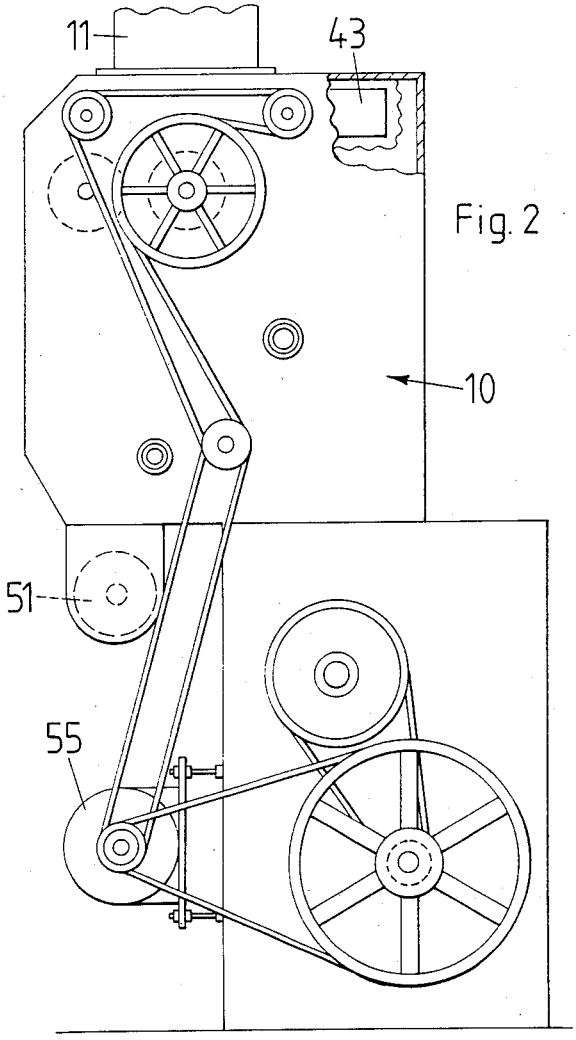
FIG. 2 is an end elevational view looking at the apparatus from the end opposite that of FIG. 1.

Referring now to the drawings for a better understanding of my invention, as stated, I will describe the same in association with a more or less standard roller gin feeder combination. Thus, at 10 I show a seed cotton feeder to which seed cotton is delivered from a conveyor-distributor, not shown, through a chute indicated at 11. The feeder 10 delivers the cotton to be ginned to a roller gin indicated generally in FIGS. 1 and 2 by the numeral 13. A suitable conveyor is located beneath the gin to carry away seed. The lint removed from the seed is discharged from the back of the gin through a lint flue 15 having a suction fan 16 connected thereto. See FIG. 3.

Figure 3:
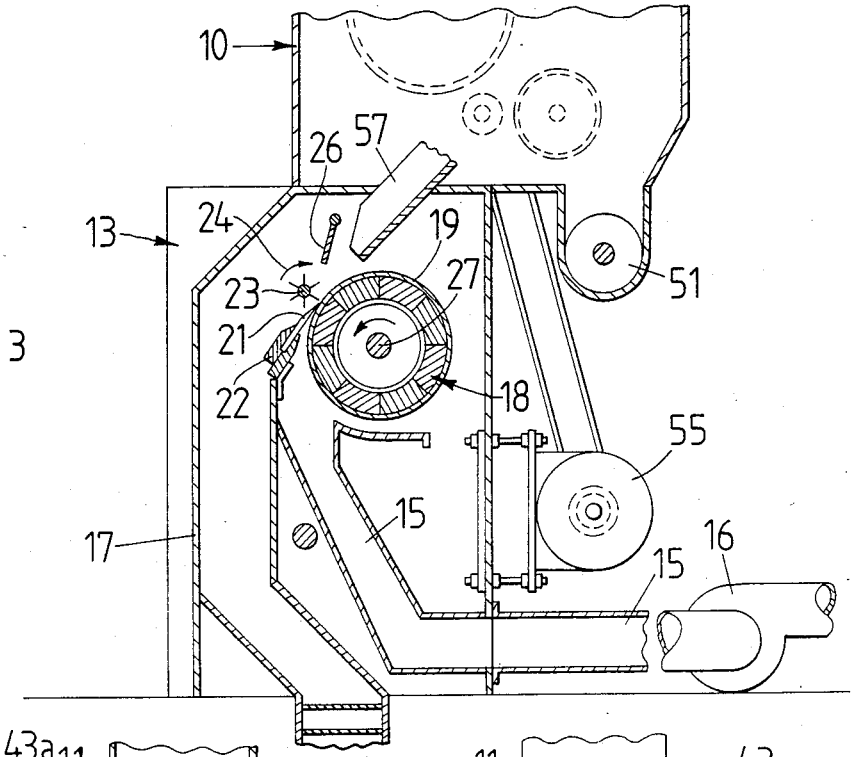
FIG. 3 is a vertical sectional view of the roller gin indicated in the drawings by the numeral 13.

Referring still to FIG. 3 it will be understood that the gin embodies the usual framework or box-like enclosure 17. Mounted in the gin 13 is a ginning roll 18 the outer surface of which is covered with a belting-like material 19 as is understood in the art. The ginning knife is indicated at 21 and is mounted on relatively heavy supporting framework 22 which spans the gin from end to end so that the knife 21 is coextensive in length with the roll 18. At 23 I show what is known in the trade as a rotor bar and which is driven in the direction of arrow 24. The bar 23 also is substantially the length of the roller 18 and knife 21.

At 26 I show a guide plate which is adjustable toward and from the roller 18 and the purpose of which is to direct the seed cotton down onto the rotating parts of the gin.

As understood, the entire roll 18 is so mounted that it may be moved into and out of operating or ginning contact with the knife 21. Thus, roller 18 is provided with a shaft 27. Each end of the shaft 27 is mounted in bearings 28. These bearings in turn are mounted on slide blocks or plates 29 and the blocks 29 are mounted in guides 31 suitably secured to the end framework of the gin structure.

At 32 and 33 we show pairs of fluid pressure cylinders, for instance, air cylinders, to which air under pressure may be supplied from lines 34. These cylinder pairs are suitably mounted on the gin framework so that the piston rods 36 thereof engage cross members 37 forming a part of the slide system for supporting the ends of the shaft 27. Thus, whenever pressure is applied to the cylinders 32 and 33 the roll 18 is pressed into ginning contact with the ginning knife. When pressure is released, due to the upward inclination of the slide assemblies, roll 18 moves by gravity downwardly and away from the knife 21 so that its surface 19 no longer engages the knife.

The feeder comprises a pair of feed rolls 42. These may be in the form of spiked members and they are driven by a variable speed electric motor, 43, through suitable chains 43*a* or the like, to rotate in the direction of the arrows, FIG. 1. Seed cotton is delivered downwardly between these rolls at a given rate as determined by the speed of the motor 43.

Immediately beneath the rolls 42 is a spike cylinder 44, the tips of the spikes 46 of which pass very closely adjacent the tips of the spikes of the rollers 42. Also mounted adjacent cylinder 44 is another spiked cylinder 47 and these two cylinders run over grids 48 and 49. Trash falling from the grids 48 and 49 is removed from the gin by a conveyor 51.

Driven in the direction of arrow 52 is an extractor saw 53. A rotary brush doffer 54 is associated with the lower periphery of the saw 53. A reclaimer saw 56 also is served by the doffer 54 generally in the customary fashion.

From the description so far given it will be seen that I have described a more or less standard roller gin-feeder combination. Thus, seed cotton enters between the rollers 42 which are driven in the direction of the arrows as indicated. The spiked cylinder 44 may be driven so that the periphery of its spikes travels faster than the rolls 42, whereby cotton is single locked as it exits from the rolls 42. This cotton is then discharge onto the grids 48 and 49 and then onto the saw 53, finally being doffed down the slide 57 located above the ginning mechanism. The various rotary mechanisms of the gin and feeder (except feed rolls 42) are driven by a motor 55 through the belts and chains shown in FIGS. 1 and 2.

Figure 7:
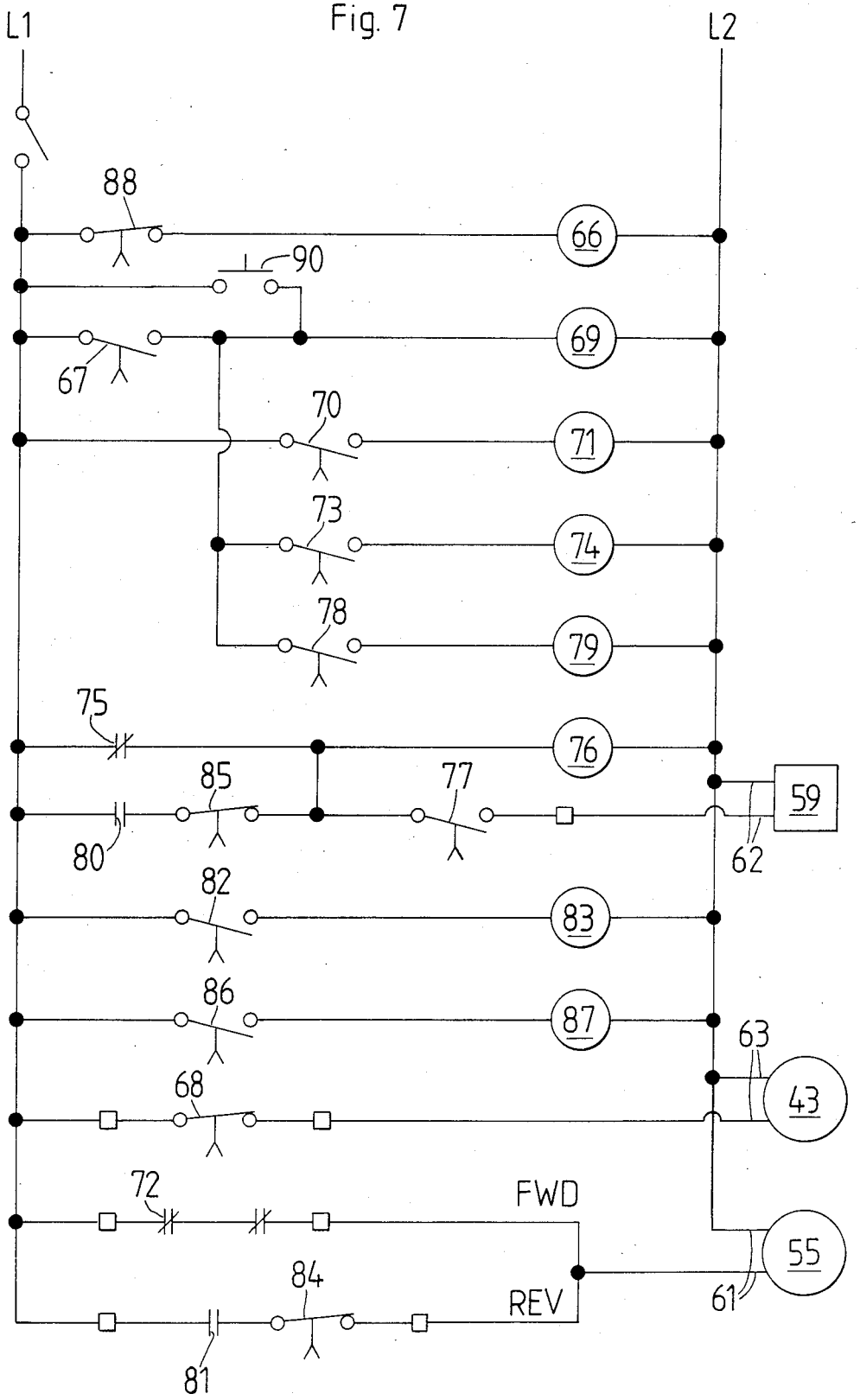

Referring now to FIG. 7 I will now describe in diagrammatic fashion the electrical and other mechanisms associated with the mechanisms already described in order to cause the gin to be self-cleaning or, if desired, to permit the same to be cleaned whenever necessary. Of course, by "cleaned" I mean to remove trash which accumulates on or adjacent the edge of the knife, the presence of which causes a deterioration in the ginning of the cotton and excessive wear on the covering 19 of the ginning roll 18.

It will be understood that the cylinders 32–33 associated with each end of the shaft 27 supporting the ginning roll 18 are under control of a common solenoid valve indicated at 59 in the drawings.

As will now be explained, the motor 55, solenoid valve 59 and motor 43 are all under control of a "brain" or master control, timing and power supply mechanism detailed in FIG. 7. As shown in FIG. 7 power is supplied to the control mechanism by lines $L^1$ and $L^2$. The power and control circuits are carried to the motor 55 through lines 61, to the solenoid valve 59 through lines 62 and to the feed motor 43 through lines 63, all connected to the control or "brain" now to be described.

The control mechanism includes, as indicated completely diagrammatically in FIG. 7, eight separate timing mechanisms which preferably are used to carry out my improved process and to operate the roller gin after the fashion of my invention. At 66 I show a timer which cycles the apparatus at preset times, for instance, each 30 minutes. That is to say, every time the timer 66 times out, the cycle hereinafter described is initiated so that the gin becomes "self-cleaning" at preset time intervals. The timing out of timer 66 closes a set of contacts 67 and opens a set of contacts 68. The opening of contacts 68 deenergizes the motor 43 which as will be recalled controls the feeding rotation of the feed rollers 42. The closing of contacts 67 energizes a time delay relay 69. Relay 69 is set to time out at an appropriate interval of time, for instance, ten seconds which permits the gin to clear all unginned cotton between the knife-roll and feeder mechanism. The timing out of relay 69 closes a set of contacts 70 which in turn energizes another control relay 71. Immediately upon the energization of relay 71 a set of contacts 72 opens, deenergizing the main drive motor 55, thus bringing the gin parts, including the roller 18, to a stop. After an interval of time, for instance two seconds, relay 71 times out, closing contacts 73. The closing of contacts 73 energizes relay 74 and this instantaneously opens a set of contacts 75, deenergizing another relay 76. The deenergization of relay 76 immediately opens a set of contacts 77 deenergizing the solenoid valve 59 and causing the cylinders 32–33 to retract the roller from the ginning position, that is, clear of the stationary knife 41. At this point in time all the moving parts of the system are at a standstill. After a time delay of about two seconds relay 74 closes a set of contacts 78 energizing another relay 79. The relay 79 is a time delay relay and controls five sets of contacts to wit, contacts 80, 81, 82, 84, and the contact shown in series with contact 72. Thus, energization of relay 79 instantaneously closes a set of contacts 80 energizing relay 76, thus initiating a five second time delay. Closing of contacts 81 starts motor 55 turning in the reverse direction, thus to drive the ginning roll 18 in the direction opposite the arrows shown in FIG. 3. At the end of the five seconds associated with relay 76, contacts 77 close energizing solenoid valve 59, moving the ginning roll back into ginning position as shown in FIGS. 3 and 4 of the drawings. The five second time delay just mentioned gives the roller time to come up to speed prior to being placed into ginning contact with the knife.

Recalling now that relay 79 was timed in while relay 76 was timing in, seven seconds after relay 76 timed in, relay 79 times in, thus closing a set of contacts 82. The closing of contacts 82 energizes another time delay relay 83, which relay may be set for a period of two seconds. At the same time contact 82 closes, another set of contacts 84 open, deenergizing the motor 55. Motor 55 coasts to a stop, it being noted that the roller 18 is in contact with the knife 21 which thus acts as a brake on the roller and all of the other parts driven by the motor 55. After two seconds elapsed time delay relay 83 opens a set of contacts 85 thus deenergizing solenoid valve 59. This permits the retraction of the roller from the knife, moving from the position of FIG. 4 to the position of FIG. 5. In this position of the parts all of the mechanisms are at rest, the roller being in the position shown in FIG. 5, that is, withdrawn from contact with the stationary knife 21. At the same time contacts 85 open, contacts 86 are closed energizing another relay 87. Two seconds after the energization of relay 87 contacts 88 open, thus deenergizing timer 66. Contacts 68 instantaneously close, starting feed roll motor 43. The system is now back in operation since deenergization of timer 66 has caused contact 67 to reopen, deenergizing relays numbered 69, 71, 74 and 79. Deenergization of relay 79 opens contact 82 thus deenergizing relay 83 which in turn instantaneously reopens contact 86, deenergizing relay 87. Contact 88 recloses upon the deenergization of relay 87. The entire circuit has thus been reset and another thirty-minute ginning program is initiated.

From the foregoing it will be seen that I have devised an improved roller gin and process for operating the same. It is the opinion of this applicant that the primary wear on the surfaces of the ginning rolls of gins of this type is not due to ginning of the cotton; on the other hand, it appears to be due to excessive friction of the knife on the surface of the roll. In view of the fact that the recovering of these rolls is extremely expensive and time-consuming, it is highly desirable to extend their life as long as possible. Therefore, with my improved gin and process the friction due to trash on the knife is eliminated effectively and periodically, and if desired, automatically. Obviously, if desired, the system may be equipped with a manual start switch indicated at 90 in the drawings. However, with the arrangement of switches, relays, etc., as shown in this disclosure, the system can be completely automated, thus resulting in a great saving of wear on the roll covering, increasing its life and thus improving the efficiency of the gin and the entire plant of which the gin forms a part.

While I have shown my invention in but one form, it will be obvious to those skilled in the art that it is not so limited, but is susceptible of various changes and modifications without departing from the spirit thereof.

What I claim is:

1. In a roller gin of the kind having a motor operated ginning roll and a knife cooperable therewith to remove lint from seed cotton, electromechanical means to reverse the direction of rotation of the roll, thereby to remove from the knife at least some of the lint, trash or the like which accumulates on the knife during ginning, said electromechanical means comprising:

(a) resetable timer means for initiating removal of said lint, trash or the like at predetermined intervals;

(b) delay means operably connected to said resetable timer means and responsive thereto for deenergizing said motor at a predetermined time;

(c) a time delay relay responsive to said delay means operably connected to said motor for energizing said motor for rotation in a reverse direction for a predetermined period; and (d) means responsive to said time delay relay for resetting said resetable timer means.

2. Apparatus as defined in claim 1 in which there is means to feed seed cotton to the gin and in which there is means operable responsive to said resettable timer means to stop the feed to said gin.

3. Apparatus as defined in claim 1 in which there is means to feed seed cotton to the gin, means to stop said feed means, and means to delay the reversal of the roll for knife cleaning purposes for a length of time to permit the ginning of cotton enroute from the feed means to the gin.

* * * * *